United States Patent [19]

Platt et al.

[11] 4,134,277

[45] Jan. 16, 1979

[54] WATER SAVER FOR WASHER USING PUMPING AGITATOR

[75] Inventors: Clark I. Platt; Jack F. Clearman, both of St. Joseph, Mich.

[73] Assignee: Whirlpool Corporation, Benton Harbor, Mich.

[21] Appl. No.: 824,788

[22] Filed: Aug. 15, 1977

Related U.S. Application Data

[62] Division of Ser. No. 680,776, Apr. 27, 1976, Pat. No. 4,077,239.

[51] Int. Cl.[2] ..... D06F 13/02

[52] U.S. Cl. ..... 68/53; 68/134

[58] Field of Search ..... 68/53, 131, 132, 133, 68/134, 184, 23.7, 18 FA

[56] References Cited

U.S. PATENT DOCUMENTS

| | | | |
|---|---|---|---|
| 3,352,130 | 11/1967 | Landwier | 68/53 X |
| 3,494,152 | 2/1970 | Pick | 68/23.7 X |
| 3,910,076 | 10/1975 | Ruble | 68/53 X |

*Primary Examiner*—Philip R. Coe

*Attorney, Agent, or Firm*—Hill, Gross, Simpson, Van Santen, Steadman, Chiara & Simpson

[57] ABSTRACT

In a clothes washer an agitator that is also a water pump draws water from the zone between the basket and the tub of the clothes washer and pumps it to the inside of the basket thereby raising the water level in the area where washing occurs during agitation and also promoting good clothes roll-over action in the treatment zone. A method of laundering articles includes the step of pumping laundering liquid into a treatment zone and radially outwardly along a lower portion of the zone during agitation to obtain a desired level of laundering liquid in the part of the zone where laundering occurs.

3 Claims, 8 Drawing Figures

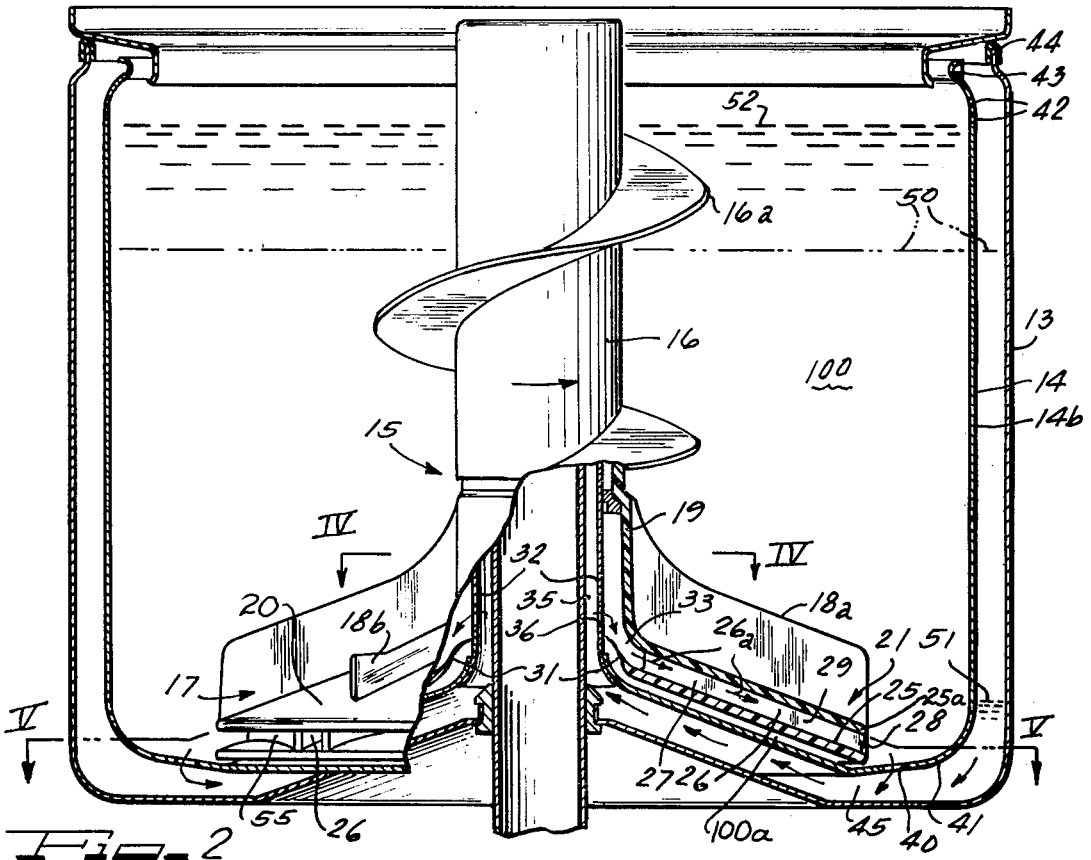
Fig. 2
Fig. 5
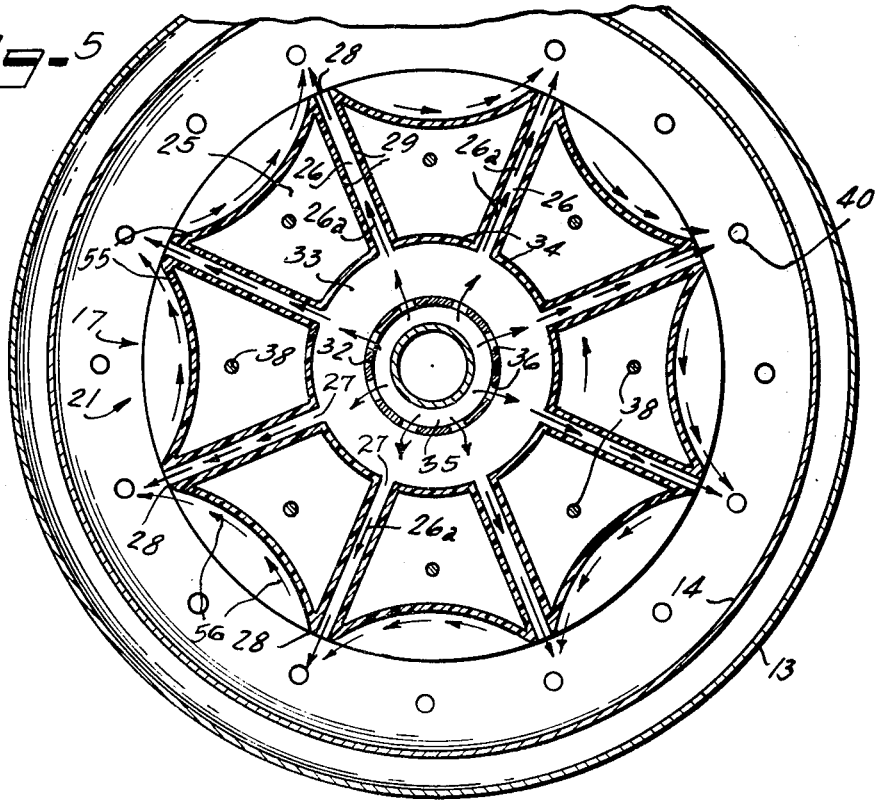

WATER SAVER FOR WASHER USING PUMPING AGITATOR

This is a division, of application Ser. No. 680,776, filed Apr. 27, 1976, and now U.S. Pat. No. 4,077,239.

BACKGROUND OF THE INVENTION

1. Field of the Invention

The present disclosure pertains to a pumping agitator for circulating wash liquids between the tub and basket of a clothes washing machine.

2. Description of the Prior Art

The prior art discloses a number of different types of washing machine agitation and liquid flow systems including the following.

U.S. Pat. Nos. 2,554,229; 2,621,505; and 2,274,402 each disclose a somewhat different liquid circulation system for a washing machine wherein a clothes basket or receptacle contains an agitator for washing clothes in wash liquid within the receptacle while some wash liquid is continuously overflowing the receptacle and a separate pump is utilized to pump this overflow liquid back into the receptacle by way of a filter.

U.S. Pat. Nos. Re. 18,280 and Re. 20,424 each disclose a different form of agitator for circulating wash liquid through the agitator itself in order to create liquid currents within the machine's washing basket for aiding the roll-over pattern of the basket's contents.

U.S. Pat. Nos. 3,022,655; 3,068,680; 3,330,135; and 3,381,505 each disclose a different form of agitator utilizing pumping vanes for circulating wash liquid through the agitator for wash liquid filtering.

Additionally, U.S. Pat. Nos. 2,744,402; 2,916,900; and 3,543,541 disclose different forms of washing machine agitators each including vanes below or within the skirt portion of the agitator for pumping wash liquid through the agitator for filtering purposes.

U.S. Pat. No. 3,352,130 discloses an agitator including radial downwardly-facing pumping vanes on the bottom of the agitator skirt for inducing a flow of wash liquid from the tub to the basket of an automatic washer through filter openings in the basket; and U.S. Pat. No. 3,626,728 (assigned to the assignee of this invention) discloses an integral basket and agitator wherein the bottom of the basket carries downwardly-facing vanes for inducing wash liquid flow from the washing machine's tub into the basket through holes in the bottom of the basket.

Finally, U.S. Pat. No. 2,722,118 discloses an agitator for an automatic washer having a double skirt portion which defines radial flow passageways therethrough; and U.S. Pat. No. 3,330,135 discloses an agitator including hollow upstanding vanes on a skirt portion of the agitator for defining radial flow passageways through the agitator.

SUMMARY OF THE INVENTION

An agitator of a vertical axis washing machine according to the present invention includes spaced upper and lower skirt portions and a plurality of peripherally spaced, radially-extending flow channels or passageways between the skirt portions. Each flow channel has a first end at the periphery of the skirt in communication with the interior of the basket and a second end in communication with a center post portion of the tub through a distribution chamber and openings in the center post portion of the basket wall. Holes in the bottom of the basket spaced radially outwardly of the agitator skirt provide for a limited flow of liquid from the basket to the tub. As the agitator oscillates it acts as a centrifugal pump drawing wash liquid from the area of the tub center post portion through the openings in the basket center post wall and radially outwardly through the passageways of the agitator into the basket. Peripheral scallops formed between the flow channel outlets augment centrifugal forces to provide a strong pumping action.

If the flow of liquid from the basket back to the tub is sufficiently limited a saving of water in each washing cycle will occur since the pumping action of the agitator will maintain the volume of liquid in the tub at a minimum, while maximizing the amount of water in the effective part of the treatment zone. In any event, a desirable toroidal action or roll-over of basket contents will be effected by the pumping action of the agitator according to the present invention, and a simple, positive fluid circulation system for filtering and/or otherwise treating the wash liquid will be provided. The device of the present invention accomplishes these advantages with virtually no additional drive power required for the agitator system.

BRIEF DESCRIPTION OF THE DRAWINGS

FIG. 2 is a cross-sectional view through the tub and basket of the automatic washer, with the agitator shown partially in elevation view and partially cut away to show a portion of the pumping means in cross-section.

FIG. 5 is a cross-sectional view from above through the flow channels of the pumping means of the present invention, also showing lower wall portions of the basket and tub taken along line V—V of FIG. 2.

DESCRIPTION OF THE PREFERRED EMBODIMENT

Figure 1:
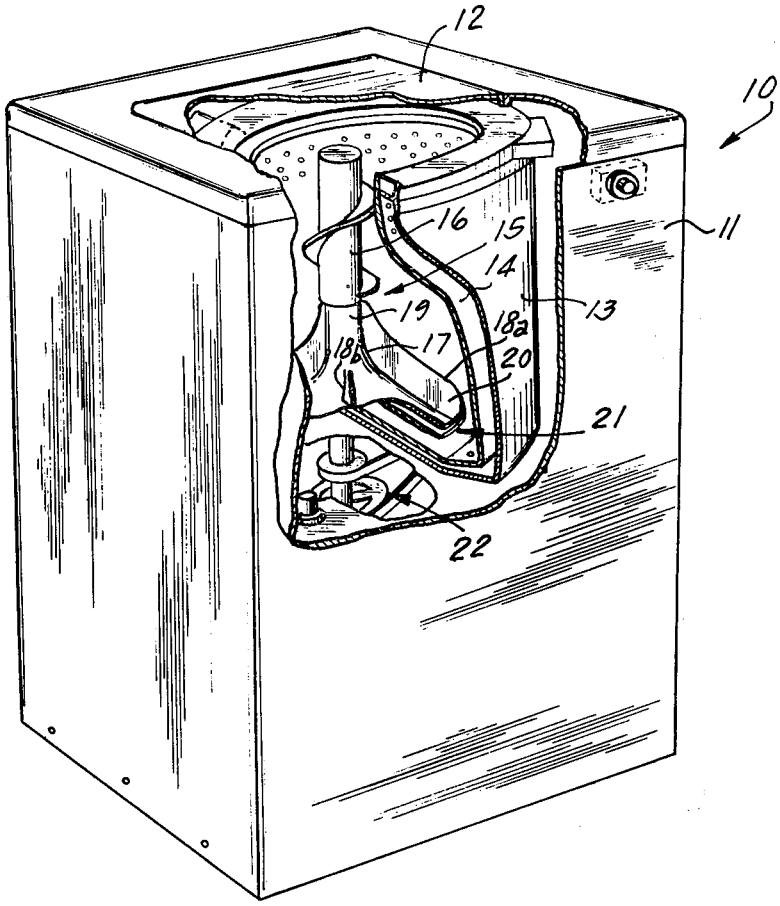
FIG. 1 is a general perspective view of an automatic washing machine partially cut away to show the placement therein of the pumping agitator of the present invention.
Figure 4:
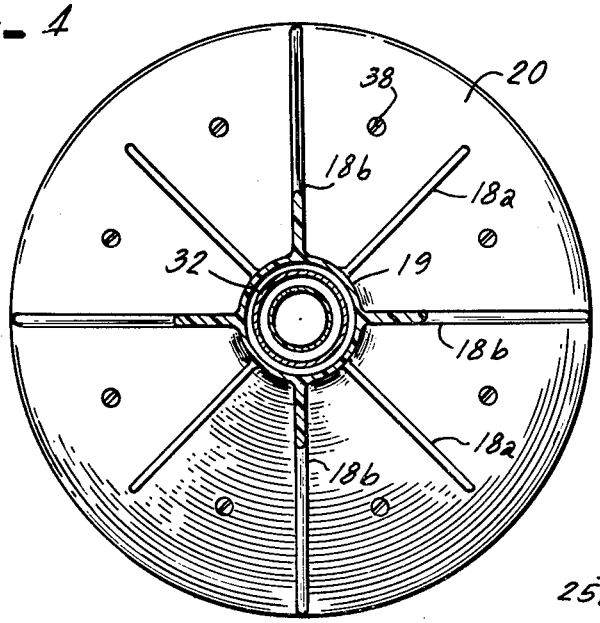
FIG. 4 is a view along line IV—IV of FIG. 2, through the center post of the oscillatible agitator, showing the vanes and skirt of the agitator assembly.

A washing machine, more specifically, a clothes washing machine of the vertical axis type, is shown in FIG. 1. The washer, indicated at 10, includes a cabinet 11 having a top access door 12. Directly beneath the access door a tub 13 and a clothes basket 14 are mounted within the cabinet, the basket and tub being coaxial and the basket contained in the tub as shown in FIGS. 1 and 2.

Figure 3:
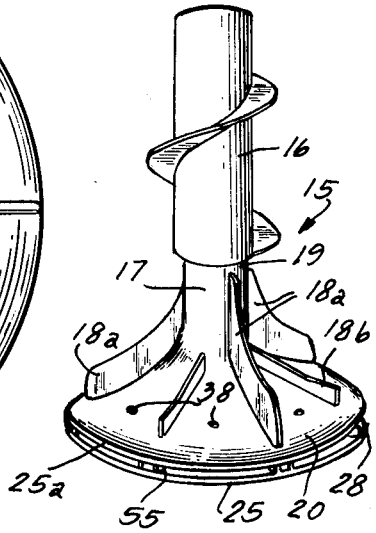
FIG. 3 is a perspective view of the agitator assembly including the pumping means of the present invention.

Within the basket and coaxial therewith is mounted agitation means shown in FIGS. 1 and 2 as an agitator assembly 15 comprising an auger portion 16 and an agitator portion 17. The auger portion 16 includes helical vanes **16*a*, and the agitator portion 17 includes an upstanding barrel portion 19 and a skirt portion 20. A plurality of scrubbing vanes are mounted directly above and adjacent the skirt portion 20, and in the illustrated embodiment shown in FIG. 3 the agitator includes rigid vanes 18*b* fixed to an upper surface of the skirt portion 20 and flexible vanes 18*a* attached to surfaces of the barrel portion 19**.

Drive means 22 are provided for oscillating the agitator portion 17 in a conventional manner as is well-known in the art. The drive means also drives the auger portion 16 of the agitator assembly so that the auger rotates unidirectionally as the agitator portion 17 oscillates. Thus the auger portion 16 rotates relative to the oscillating agitator portion 17 to auger the clothes or other fabrics adjacent the auger portion downwardly towards the lower portion of the receptacle or treatment zone where agitation is taking place. The construction and operation of a dual action agitator including an auger portion similar to the one just described is disclosed in the co-pending U.S. patent application of Clark Platt, Ser. No. 595,792, assigned to the assignee of the present invention.

The basket 14 and the tub 13, upon the start of a washing cycle, will be filled with water to a level 50 (see FIG. 2), which will be common in both the basket and tub if a certain form of input stream splitter is used or if water can flow through apertures in the bottom portion of the basket 14 quickly enough with regard to the input rate to raise the level in the tub at the same rate as it is raised in the basket. As soon as water fill is complete, through operation of conventional controls in a known manner, the drive means 22 will begin to operate the agitator assembly 15. Thus during a washing cycle the tub 13 contains washing liquid and the basket 14 contains washing liquid and items to be washed such as, for example, clothing or other fabrics. The agitation means subject the basket contents to a washing action as the agitator portion 17 creates a turbulence adjacent the items being washed, with the rotating auger portion 16 moving the items to be washed downwardly in proximity to the scrubbing vanes and the oscillating scrubbing vanes contacting the items and subjecting them to a scrubbing action.

In a washing machine having a pumping agitator according to the present invention, laundry detergent and other appropriate additives may be introduced into the wash liquid by dumping them directly either into the basket or into the space between the tub and the basket, and the pumping action of the agitator will thoroughly mix them with the liquid already in the tub.

The drive means also spins the basket during a centrifuging operation at the conclusion of the washing cycle. During the centrifuging operation liquid in the basket is drained or forced out into the tub through holes in the basket sidewall or through spin outlet openings 42 in the upper sidewall of the basket subjacent a spin overflow lip 43. The liquid is then pumped from the tub to drain.

While the agitator means according to the present invention is shown as including an auger means which rotates unidirectionally relative to the oscillating agitator portion, it should be understood that the principles of the present invention may be applied equally well to an agitation means without the auger portion.

The details of the improved agitator 17 according to the present invention are shown in FIGS. 2, 3, 4 and 5. It will be observed that the agitator according to the invention is a pumping agitator including water pumping means 21 integral with the skirt portion 20. The skirt portion includes spaced lower and upper wall portions 25 and **25*a* respectively, and circumferentially-spaced radially-extending pumping channels are defined by lateral walls 29 and the lower and upper wall portions 25 and 25*a*. Eight such pumping channels or walled flow passages 26 are shown in FIG. 5, and each one includes a radially inner end portion 27 and a radially outer end portion 28. The outer end portion of each flow passage is joined to the outer end portions of adjacent flow passages by radially inwardly-scalloped peripheral wall segments 55, and the inner end portions 27 of adjacent flow channels are joined by peripheral wall segments 34. The lower and upper wall portions 25 and 25*a* respectively may be attached to one another adhesively or by any other convenient means such as screws 38**.

Figure 7:
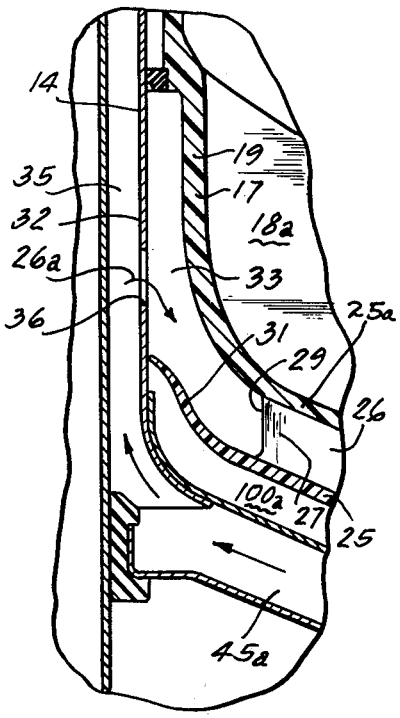
FIG. 7 is a detailed view in cross-section of the lower center post area of the tub showing the relationship of the tub, the basket, and the agitator according to the present invention.

As shown in FIG. 7, the lower wall portion 25 extends radially inwardly of the end portions 27 and includes an annular flange portion or water lip seal 31 which terminates adjacent a center post portion 32 of the basket 14. A distribution chamber 33 is therefore defined by surfaces of the agitator 17, the basket center post portion 32, the lower wall portion 25, and the peripheral walls 34 (see FIG. 5); and the distribution chamber 33 communicates with each of the flow passages 26.

Figure 6:
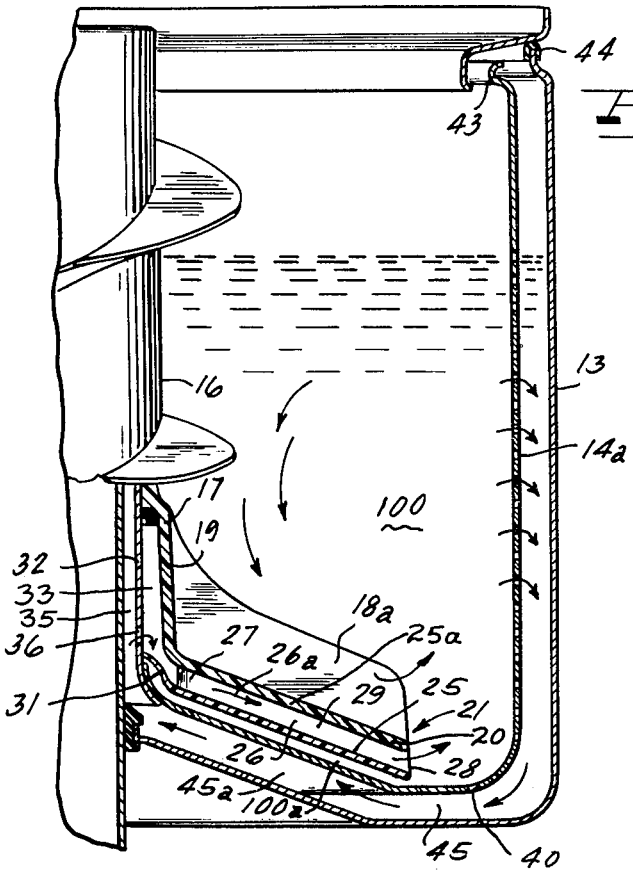
FIG. 6 is a partial view similar to FIG. 2 but showing a basket including a perforated sidewall portion.

Openings 36 are provided in the center post area 32 of the basket wall so that fluid communication will exist between the interior 100 of the basket and the volume 45 of the interior of the tub defined outside the basket as shown in FIG. 6. Therefore, as the agitator 17 oscillates the skirt portion 20 of the agitator acts as a centrifugal pump and pumping means 21 tends to pump liquid from the volume 45 between the basket and the tub, specifically from the space 45 beneath the basket, and into the basket. This liquid is pumped through the basket openings 36, into the distribution chamber 33, and outwardly through the flow channels 26 as indicated by the arrows **26*a* in FIG. 2, 5, 6 and 7**. The liquid directed outwardly through the flow passages passes outwardly into the basket and tends to create favorable liquid currents in the basket which aid roll-over of the basket contents.

Roll-over, or toroidal movement of the contents within the basket is defined, for purposes of this application, as a movement pattern of the contents including fabrics being washed downwardly along the center post of the agitator assembly, outwardly along the bottom region of the basket, upwardly along the outer perimeter regions of the basket, and inwardly towards the upper portion of the agitator assembly. During the wash cycle this roll-over or toroidal movement pattern is repeated continuously and contributes significantly to good washing results.

The pumping agitator according to the present invention improves roll-over of the basket contents during the wash cycle by the centrifugal pumping action it generates. Thus in the embodiment shown in FIG. 2, the auger portion 16 of the agitator assembly will move fabrics including articles of clothing downwardly along the agitator assembly center post, and the scrubbing vanes adjacent the skirt portion 20 will tend to move fabrics outwardly along the lower regions of the basket. In addition, the liquid being pumped outwardly through the skirt portion 20 will cause outwardly directed currents along the bottom region of the basket which liquid currents will be directed upwardly along the outer perimeter of the basket by contact with the basket sidewall. The oscillatory to-and-fro motions of the agitator skirt follow one another so rapidly that there will be little or no flow of liquid radially inwardly through the flow channels 26 in opposition to the momentum of the outwardly moving fluid.

Openings in the lower portion of the basket wall such as those indicated at 40 in FIGS. 2 and 5 will allow liquid to flow from the basket back to the tub. The volume of liquid flowing from the basket to the tub may be increased by increasing the size and number of holes through the basket walls. For example, in FIG. 6 the basket is shown as having an apertured sidewall so as to allow practically unrestricted flow of liquid through openings 14*a* from the basket to the tub. Of course, the total flow even in the embodiment shown in FIG. 6 will be limited by the pumping capacity of the pumping agitator, but generally the greater the flow volume the greater will be the pumping agitator's contribution to the roll-over pattern of the basket contents during a wash cycle.

The liquid barrier or water lip seal means comprising the annular flange 31 encompassing the basket center post below the openings 36 serves to insure that the pumping agitator will draw liquid from the tub through the first set of openings 36 and substantially prevent radially-inward liquid flow in the basket under the lower portion of the agitator, that is in the region 100*a* between the lower portion of the agitator skirt portion and the lower wall portion of the basket. Such radially-inward flow would substantially impair the pumping efficiency of the pumping agitator and would also have an undesirable tendency to pull clothes under the agitator skirt. Providing the water lip seal or barrier means ensures a positive net flow into the basket through the first set of openings 36 and back into the tub through the second set of basket openings 40 or 14*a*. Appreciable liquid flow in the basket under the lower portion of the agitator is prevented inasmuch as virtually all liquid passing through the first set of openings 36 must pass through the pumping agitator. Thus any counter flow of liquid from the basket to the tub through holes 36 must also first pass through the flow channels 26.

Figure 8:
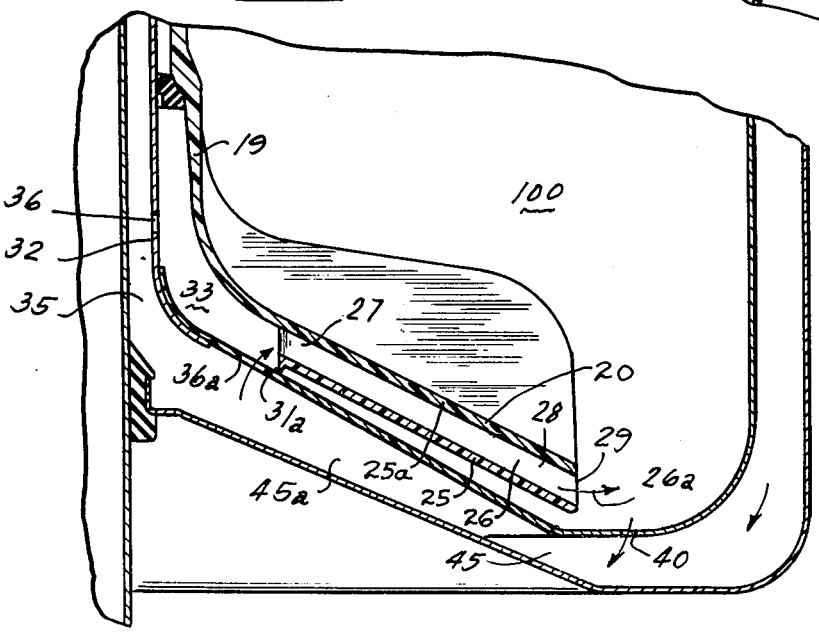
FIG. 8 is a view similar to FIG. 6 but showing an alternative embodiment of the pumping agitator according to the present invention.

A somewhat modified form of liquid barrier means is shown in FIG. 8. In this form of the invention an annular water lip seal or flange 31*a* extends downwardly from the lower wall portion 25 of the skirt 20 to contact the bottom surface of the basket. This modified form of flange also prevents appreciable liquid flow between the agitator and the bottom of the basket and ensures efficient pumping of liquid through the openings 36.

With the first set of openings 36 and the second set of openings 40 defined through a bottom wall portion 41 of the basket a substantially continuous flow of liquid will be maintained from the tub to the basket through holes 36 and from the basket to the tub through holes 40. In addition, heavy particles such as sand or the like will pass from the basket to the tub through the holes 40 and settle on the bottom of the tub in a sump portion 45 thereof until the washing cycle is completed, at which time these heavy sediment particles are discharged to a drain along with the used wash liquid.

Referring again to FIG. 2, the basket there shown includes a first set of openings 36 and a second set of openings 40 but the outer sidewall 14*b* of the basket is substantially imperforate (although there are spin outlet openings 42 in the upper sidewall of the basket as mentioned above). With this arrangement and with an appropriate number of properly sized holes 40 the pumping agitator, when oscillated during the washing cycle, will initially pump liquid from the tub into the basket faster than the liquid can run from the basket back into the tub through the holes 40. In this way, when the pumping rate has stabilized, the liquid level in the basket will be maintained during the washing cycle at a level substantially above the level of the wash liquid in the tub outside the basket. Thus, as seen in FIG. 2, wash fluid is pumped from the center post portion 35 of the tub 13 into the basket 14, and washing fluid in the sump portion 45 of the tub is consequently drawn radially inwardly beneath the bottom portion 41 of the basket. The apertures 40 in the lower wall portion 41 of the basket are appropriately sized so that only a very limited quantity of fluid from the basket may flow out of the basket to replenish the fluid drawn from the tub sump 45 through the openings 36 and the distribution chamber 33 and into the main portion of the basket. The net removal of water from the space between the basket and the tub by the pumping agitator will raise the water level 50 inside the basket to an operating level 52 while the liquid level in the space between the tub and basket is reduced to a level 51. The foregoing assumes that only the apertures 36, 40, and 42 are provided in the walls of the basket 14.

This difference in water levels between liquid in the basket and liquid in the tub outside the basket is held relatively stable during the washing cycle through the above-described basket construction and pumping action of the agitator and is advantageous because all the washing occurs within the basket and the volume of wash liquid in the tub region outside the basket generally contributes nothing to the washing operation. The pumping agitator in combination with a substantially imperforate basket or in combination with a basket having an appropriate number of appropriately sized holes such as, for example, the embodiment shown in FIG. 2 will thus provide a highly desirable water saver feature. Less liquid is added to the tub at the beginning of the cycle, and consequently less detergent and less additives are needed and less energy is required to heat the reduced volume of water. When the washing cycle begins the pumping agitator will quickly bring the liquid level in the basket up to the level required for the washing operation, and will maintain this higher level in the basket so long as the agitator continues to oscillate.

Although substantial pumping action is provided by the pumping agitator merely from centrifugal forces operating on fluid within the flow channels, it has been shown that addition of the radially inwardly-scalloped wall portions 55 joining the lateral walls 29 of the flow channels 26 between their outer end portions 28 will substantially augment the net flow from the pumping means 21. As shown in FIG. 5, a counter-clockwise oscillation of the agitator portion 17, which comprises the pumping means 21, relative to the basket 14 will induce a generally clockwise peripheral motion of fluid adjacent and above the axis of the pumping means 21, as indicated by the arrows 56. An opposite motion will be produced upon a clockwise oscillation of the agitator 17. The flow indicated by the arrows 56 produces a venturi-like effect on fluid within the flow channels 26, which will increase the efficiency of the pumping means and significantly multiply the flow rate through the flow channels 26.

It has been found that the combination of a tub having a 23 gallon capacity, a basket having four $\frac{1}{2}''$ holes 36 equally spaced around the center post and sixteen $\frac{3}{8}''$ holes 40 circumferentially spaced along the bottom of the basket, and a pumping agitator according to the present invention, provided an initial flow rate of 5 gallons per minute and an equilibrium flow rate during the wash cycle of about 3 gallons per minute. A four inch liquid level differential was maintained at equilibrium between the basket and the tub outside the basket, and this amounted to a liquid savings of approximately 4 gallons. To achieve this indicated water savings the skirt portion of the agitator including the pumping vanes had a diameter of 12-¾" and oscillated with a 196° stroke at a rate of 68 strokes per minute in a basket having an outside diameter of approximately 21-½" and a center post diameter of approximately 3-3/16". It was found that the 4" liquid level differential was maintained regardless of the quantity of liquid in the tub so long as the liquid level in the tub was no less than 7 inches.

Although various modifications might be suggested by those versed in the art, it should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a vertical axis washing machine having a tub and a spin basket therein, the spin basket having side and lower walls and a center post formed sealingly together and forming restricted first and second sets of apertures respectively through the lower wall and the center-post thereof, and the side wall being substantially imperforate; and agitator means arranged within the basket and having water pumping means to draw water in a first flow from the basket and into the tub through the first set of apertures and in a second flow from the tub into the basket through the second set of apertures, the second flow being greater than the first flow until a substantial water level differential is established between the basket and tub, whereby to conserve water, energy, and wash detergent by transferring water from the tub to the basket for contact with articles therein to be washed.

2. A washing machine having a tub for containing wash liquid, a basket mounted in the tub for containing items to be washed and including a continuous peripheral wall having side and lower walls and a center-post, the side wall having perforate uppermost parts and imperforate middle and lower parts, and the lower portion wall having first opening means and the center post having second opening means therethrough for affording a variable net liquid communication from said tub to said basket depending on liquid levels in the basket and tub, a pumping agitator oscillatibly mounted in the basket, and drive means for oscillating the agitator during a washing cycle, wherein said pumping agitator includes means for pumping liquid from said tub to said basket through said second opening means in response to the oscillation of said agitator, whereby the first and second opening means and the pumping agitation increase the level of liquid in said basket and maintain it above the level of liquid between said tub and said basket while said agitator oscillates.

3. A washing machine having a tub for containing wash liquid, a basket mounted in the tub for containing items to be washed, a pumping agitator oscillatibly mounted in the basket, and drive means for oscillating the agitator during a washing cycle, said basket including a substantially imperforate cylindrical side wall, a lower wall defining a restricted first opening affording liquid communication of a first flow volume from said basket into said tub, and a center post defining a second opening affording liquid communication of a second flow volume from said tub to said basket, said second flow volume being not less than the first flow volume, said pumping agitator having a lower skirt adjacent said lower wall of said basket and said skirt including a centrifugal pump means integral therewith for pumping liquid up to said second flow volume from said tub to said basket through said second opening in response to the oscillation of said agitator, whereby the liquid level in said basket is increased and is maintained above the liquid level in said tub outside said basket during said washing cycle with said first and second flow volumes equalized.

* * * * *